United States Patent [19]

Maerte et al.

[11] Patent Number: 4,958,752

[45] Date of Patent: Sep. 25, 1990

[54] INVENTION BUMP FOR LIQUID MEDIA

[75] Inventors: Leo Maerte, Sipplingen, Fed. Rep. of Germany; Michael Wolter, Landschlacht, Switzerland

[73] Assignee: Erich Pfeiffer GmbH & Co. KG., Fed. Rep. of Germany

[21] Appl. No.: 227,652

[22] Filed: Aug. 3, 1988

Related U.S. Application Data

[63] Continuation of Ser. No. 885,505, Apr. 23, 1986, Pat. No. 4,776,498.

[30] Foreign Application Priority Data

May 15, 1985 [DE] Fed. Rep. of Germany ..... 3717558

[51] Int. Cl.[5] ..... B05B 11/02

[52] U.S. Cl. ..... 222/321; 222/376; 222/385; 222/402.19; 239/334

[58] Field of Search ..... 222/321, 376, 385, 402.19; 239/333, 334, 342

[56] References Cited

U.S. PATENT DOCUMENTS

| | | | |
|---|---|---|---|
| 2,332,007 | 10/1943 | Parker | 137/38 |
| 3,185,354 | 5/1965 | Lipman | 222/321 |
| 3,211,346 | 10/1965 | Meshberg | 222/321 |
| 3,257,961 | 6/1966 | Schlenker | 222/321 X |
| 3,414,169 | 12/1968 | Corsette | 222/321 |
| 3,463,093 | 8/1969 | Pfeiffer | 222/321 X |
| 3,556,353 | 1/1971 | Echols | 222/321 X |
| 3,640,470 | 2/1972 | Susuki et al. | 222/321 X |
| 3,724,726 | 4/1973 | Susuki et al. | 222/321 |
| 3,908,870 | 9/1975 | Nozawa et al. | 222/385 X |
| 4,056,216 | 11/1977 | Lotuby | 222/385 |
| 4,117,957 | 10/1978 | Duffey | 222/321 |
| 4,174,790 | 11/1979 | Nozawa et al. | 222/385 X |
| 4,193,551 | 3/1980 | Saito et al. | 222/321 X |
| 4,277,001 | 7/1981 | Nozawa | 222/376 X |
| 4,371,098 | 2/1983 | Nozawa et al. | 222/321 |
| 4,723,692 | 2/1988 | Meuresch et al. | 222/402.19 |

FOREIGN PATENT DOCUMENTS

| | | | |
|---|---|---|---|
| 1201684 | 9/1965 | Fed. Rep. of Germany . | |
| 3045565 | 6/1982 | Fed. Rep. of Germany | 222/376 |
| 3106190 | 6/1982 | Fed. Rep. of Germany . | |
| 2818560 | 9/1982 | Fed. Rep. of Germany . | |

*Primary Examiner*—Kevin P. Shaver

*Attorney, Agent, or Firm*—Eckert, Seamans, Cherin & Mellott

[57] ABSTRACT

The thrust piston pump of a delivery apparatus for liquid media and the like is provided with a valve arrangement in the suction passage. The valve arrangement has two valve seats acting in opposing manner and is associated with a single common valve body. This permits a rapid transfer of the valve body into the closed position engaging on the valve seat, particularly during operation in an inverted position. In addition, the discharge passage has a mechanically openably discharge valve which can be simply opened by displacing the actuating head of the pump with respect to a collar of the pump piston.

17 Claims, 4 Drawing Sheets

INVENTION BUMP FOR LIQUID MEDIA

BACKGROUND OF THE INVENTION

The present invention relates to delivery apparatus with a thrust piston pump for discharging media, particularly liquids from a storage vessel or the like in the normal position and the opposite inverted position, whereby the pump thereof has a cylinders and, for defining a pump chamber, a manually displaceable piston unit therein, together with a discharge passage and suction ports for the normal and inverted positions, whereof the suction port for the normal position is provided with a valve arrangement in the manner of a check valve closing in the case of an overpressure in the pump chamber and in the inverted position in the case of a vacuum in the pump chamber, said valve having two valve seats arranged in opposing manner, in each case for the engagement of a movable valve body, for example a ball.

An atomizer is known (German Pat. No. 28 18 560), in which two separate suction valves with separate valve bodies are arranged in axial succession in the suction port. In the case of such delivery, discharging or dispensing apparatuses, one of the suction valves both in the normal position and in the inverted position is used for closing the suction port during the pump stroke, i.e. in the case of an overpressure in the pump chamber, while the other suction valves serves to close the suction passage only in the inverted position under the weight force acting on the associated valve body and during the return stroke of the pump piston, so that a vacuum builds up in the pump chamber and towards the end of the return stroke medium is only sucked in via a separate suction port provided exclusively for the inverted position. So as to ensure during the following pump stroke performed in the inverted position, that there is only a discharge of medium through the discharge passage and not back into the storage vessel, the valve body of the firstmentioned suction valve must be brought into the closing position by the flow of a partial quantity of the medium displaced from the pump chamber counter to its weight force. Independently of the flow direction in which the valve bodies of the two discharge valves are successively arranged, this process is disturbed by the second discharge valve due to the flow resistance emanating therefrom, so that a rapid or immediate transfer of the valve body of the first discharge valve into the closed position is prevented, which leads to variations regarding the medium quantity dischraged during each pump stroke, i.e. to dosing inaccuracies. The arrangement of two separate valve bodies is complicated and takes up a large amount of additional space.

SUMMARY OF THE INVENTION

The object of the present invention is to provide a delivery apparatus of the aforementioned type, particularly a double-acting valve arrangement, which in the case of simplified construction ensures a rapid response in the particular operating position and more especially in the inverted position.

According to the ivention, this object is achieved in the case of a delivery appararus of the aforementioned type in that a common valve body is provided for both valve seats. This single valve body, which cooperates with both valve seats, is consequently directly influenced by the changing pressure and flow conditions, without any flow disturbance by a further valve body, so that a very rapid reaction of said valve body is ensured.

In a very simple embodiment, the described operation is further improved in that the valve seats are arranged on both ends of a valve chamber receiving the valve bodies and which preferably has through, approximately constant internal cross-section between both valve seats, so that the valve body can be held on a straight movement path in the case of an approximately equiaxial arrangement of the valve seats. Through the choice of the size of the annular clearance between the valve body and the valve chamber, it is possible to precisely define the flow forces acting on the valve body.

According to a further development of the invention, the valve seat more remote from the pump piston is formed by an insert more particularly located in the central axis of the pump piston and which is inserted in the end of a suction connection of a cylinder casing forming the cylinder. This insert can be fitted much more easly than an insert to be fitted from the pump chamber and is therefore additionally suited to constituting a plug-in member for receiving a suction hose or the like to be fitted in the manner of a riser.

As a result of the inventive construction, it is also possible in advantageous manner to so design the valve seat closer to the pump piston, i.e. directly conected to the pump chamber, that it defines a valve opening, which, in the manner of a rebound jet nozzle preferably tapered towards the valve body is directed against the latter towards the opposite valve seat. The space between the rebound jet nozzle and the valve body associated with the opposite valve seat and which is formed by the same valve body which is also associated with the valve seat adjacent to said nozzle, is consequently completely free for the flow coming out of the pump chamber during the pump stroke, so that said flow acts directly on the valve body and in the inverted position can transfer it into the higher, associated closed position, counter to its weight force.

A particularly advantageous construction, particularly of a delivery apparatus of the aforementioned type comprises arranging in the discharge passage a discharge valve which is mechanically opened towards the end of the pump stroke and whose discharge valve body movable between the closed and open position is displaceable into the open position with a pump actuating head with respect to the valve seat. This discharge valve serves to open the discharge passage only when a relatively high pressure has built up in the pump chamber, so that then the medium can be suddenly discharged, which is particularly advantageous if the medium is to be atomized during discharge. The opening time of the discharge valve can be much more precisely controlled, if it is not controlled by means of an intermediate piston influenced by the pressure in the pump chamber, i.e. hydraulically and is instead mechanically controlled in path-dependent manner directly with respect to the pump stroke. Instead of opening the discharge valve by axially resilient comrpession of a piston collar forming the pump piston, in the construction according to the invention the component forming the pump pistom is not compressed and instead the discharge valve body is slid via the actuating head with respect to the valve seat. This solves the problem of providing a discharge valve which, in the case of a simple, robust construction, requires little radial construction spaced and can be opened in an easy action manner with limited force.

If the discharge valve seat is formed by a sleeve-like piston collar forming the pump piston and traversed by the discharge passage, the discharge valve body can be slidably mounted, e.g. on the inner circumferential surface of the piston collar, so as to be displaceable in a simple manner with a valve stem, while for obtaining favourable spatial conditions, the valve stem is appropriately located on the outlet side from the valve body closing surface.

In order to be able to fix the pump piston towards or at the end of the pump stroke with respect to the cylinder, the pump piston is stop-limited at the end of the pump stroke, particularly by an inner shoulder located at the end of the piston path. The actuating head, including the discharge valve body, in said piston end position is to be held with respect to the pump piston in the discharge valve open position.

The reliable and immediate closing of the discharge valve at or before the beginning of the return stroke of the pump piston can be achieved very simply in that a restoring spring for the piston unit is arranged as a closing spring for the discharge valve and is preferably supported on the piston unit exclusively by means of the discharge valve body.

Accordng to a further development of the invention, the actuating head is directly mounted on the piston unit, particularly on a piston neck slidably receiving the discharge valve stem forming the outer end of the piston collar, so that the piston neck is guided both on the inner and outer circumference in a slidable manner with respect to the actuating head and can therefore be given a very thin-wall construction without any risk of compression. In a simple embodiment, the actuating head receives the piston neck in a sliding sleeve, the actuating head being stop-limited e. g. by a collar engaging in an annular clearance, both in the direction of the pump stroke and in the direction of the return stroke appropriately between two end positions, roughly corresponding to the closed and open position of the discharge valve, with respect to the valve seat of the latter or with respect to the piston neck.

A further simplification in the construction of the delivery apparatus is obtained if the actuating head is provided with an internal ram for entraining the discharge valve body, said ram preferably engaging on the outer end face of the valve stem and centrally defining an annular portion of the discharge passage located in the actuating head. This also ensures very simple fitting. However, it is also conceivable to construct the actuating head in one piece with the discharge valve body, in such a way that said internal ram passes in one piece into the valve stem.

These and further features of preferred further developments of the invention can be gathered from the description and drawings, it being possible to realize the individual features, either alone or in the form of subcombinations, in an embodiment of the invention and in other fields.

BRIEF DESCRIPTION OF THE DRAWINGS

The invention is described in greater detail hereinafter relative to non-limiting embodiments and the attached drawings, wherein.

DETAILED DESCRIPTION OF THE PREFERRED EMBODIMENTS

Figure 1:
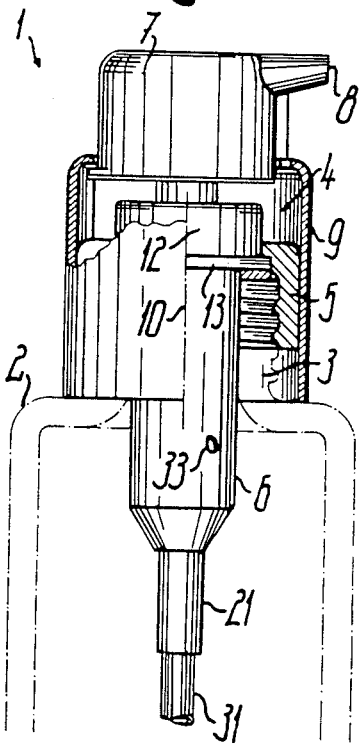
FIG. 1 Is an inventive delivery apparatus in part sectional view.
Figure 2:
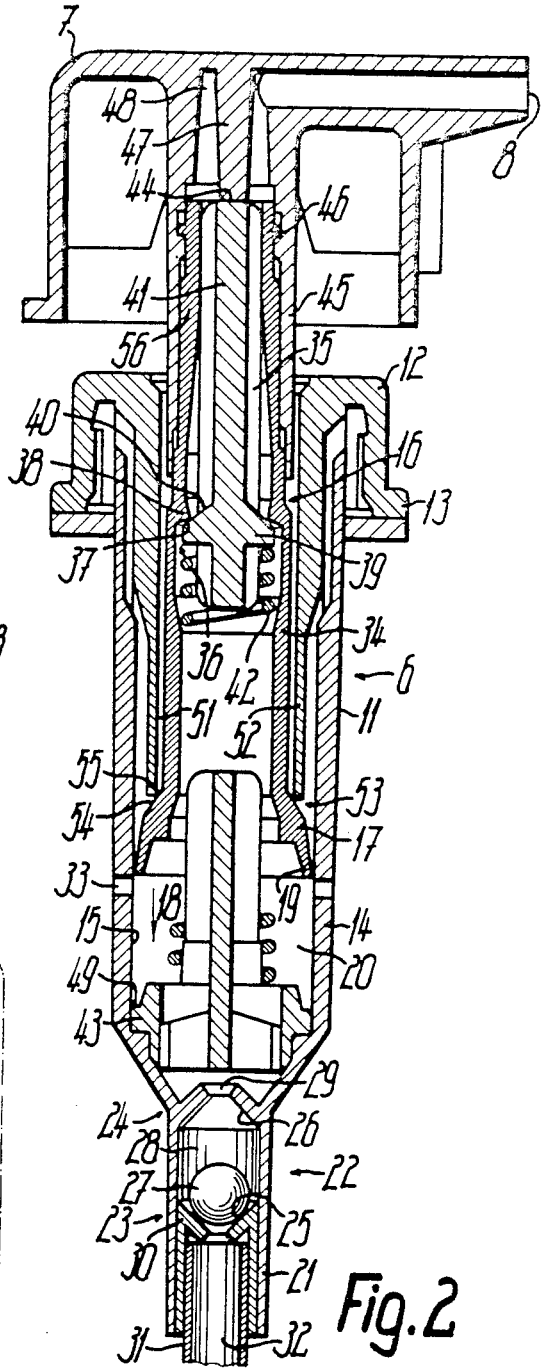
FIG. 2 Show the thrust piston pump of the delivery apparatus of FIG. 1 in an enlarged axial section and in the initial position.
Figure 3:
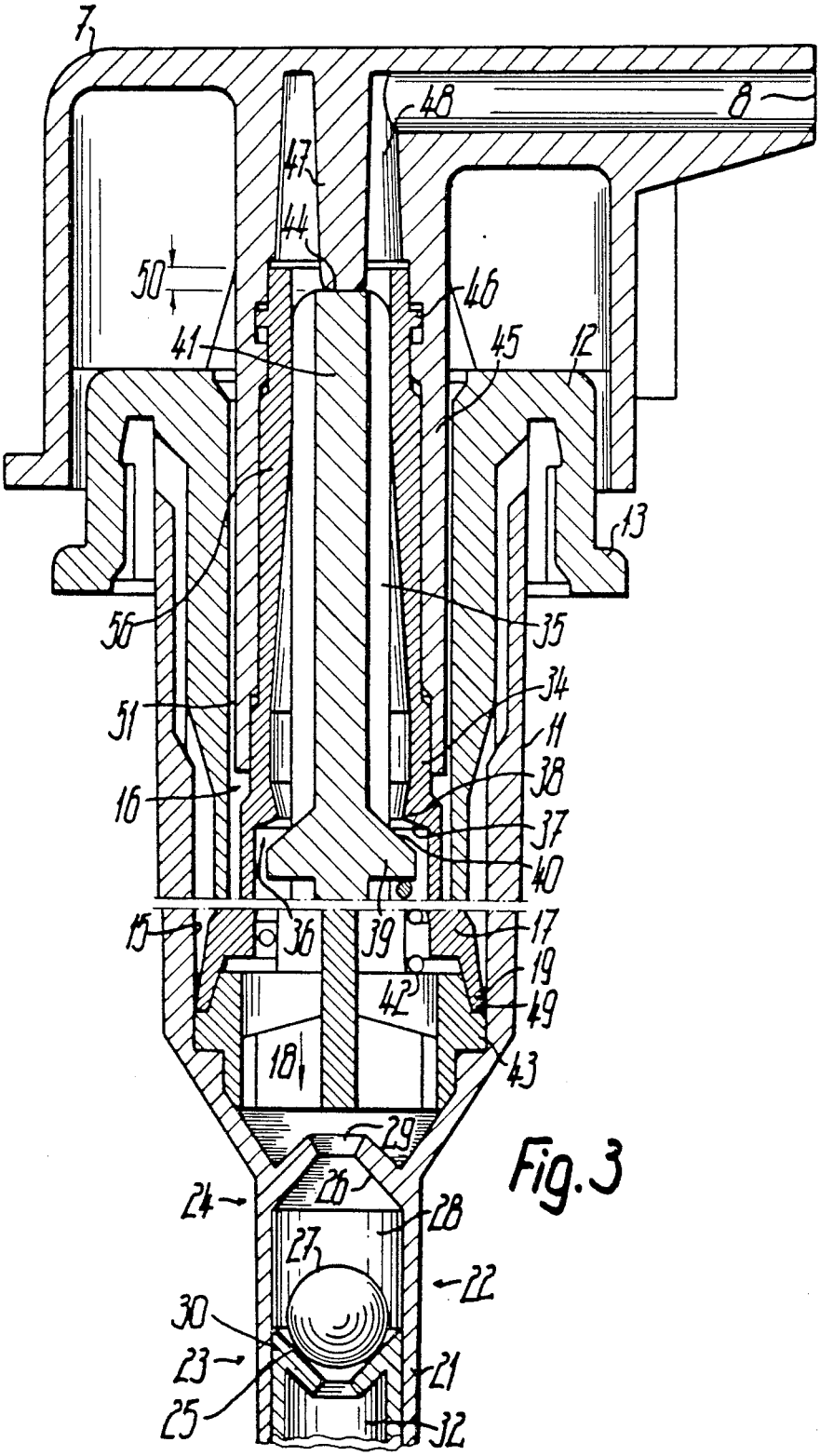
FIG. 3 Is a further enlarged axial section through the pump according to FIG. 2, but at the end of the pump stroke.

As is shown in FIGS. 1 to 3, a delivery apparatus 1 to be fixed to the neck 3 of a storage vessel 2 or the like has a pump 4 constructed as a thrust piston pump, which projects into or through the vessel neck 3 with a fastening cap 5 in such a way that the vessel 2 is tightly closed. An actuating head 7, operable by manual pressure and which carries the discharge port 8 of the delivery unit 1 is mounted on the outer, plunger-like end of a piston unit located substantially in the pump casing 6 and which projects from the latter. Actuating head 7 projects partly into a cover 9 receiving the fastening cap 5 and the end of pump casing 6 projecting therefrom. Actuating head 7, including the piston unit can be guided in rotation-proof manner in said cover 9. The described parts are located in the central axis 10 of the thrust piston pump.

The pump casing 6 is formed by a diameter-stepped, tubular cylinder casing 11 and a sleeve-like cylinder 12, which is fitted to the outer, further end of cylinder casing 11 and adjacent to its inner end face has a collar 13 for sealed engagement on vessel neck 3. On an inner portion of its length, cylinder casing 11 forms a pump cylinder 14, whose inner face is provided as a piston path 15 for a pump piston 17 arranged on the inner end of piston unit 16. In the direction of the pump stroke indicated by arrow 18, piston 17 has an acute-angled, frustum-shaped-extended, sleeve-like piston lip 19, whose annular terminal edge, which simultaneously forms the inner end of the piston unit 16 or pump piston 17, guides it in sealed manner on the piston path 15. A pump chamber 20 is defined by pump piston 17 with cylinder 14.

The inner end of cylinder casing 11 passes via a frustum-shaped, tapered portion into a diameter-reduced suction connection 21 in which is provided a suction valve arrangement 22, which with respect to the action comprises two suction valves 23, 24. The suction valves 23, 24 have separate, opposing valve seats 25, 26, but a single, common valve body 27, which in the represented embodiment is a ball freely movable in a valve chamber 28 between the two valve seats 25, 26. However, it can also be formed by a valve body with a different shape configuration and it is then appropriately guided in predetermined manner between its operating positions. In the represented case, the two valve seats 25, 26 are identical, i.e. widened in frustum-shaped manner towards or away from one another, the valve chamber 28 being continuously cylindrical between the valve seats. The valve seat 26 closer to pump chamber 20 and which is formed by a frustum jacket projecting freely in the direction of pump chamber 20, constructed in one piece with cylinder casing 11 and located in the vicinity of the associated end of suction connection 21, defines towards the pump chamber 20 a valve opening 29 located in said chamber 20 and in central axis 10, which in the manner of rebound discharge or jet nozzle tapers in acute-angled, frustum-shaped manner towards the interior of valve chamber 28 and is so symmetrically directed against valve body 27, that a medium jet coming from it forces valve body 27 immediately against valve seat 25. Valve seat 26, whose valve opening can be larger than valve opening 29, is formed by a sleeve-like insert 30, which is inserted therein from the end of suction connection 21 and whose external diameter is essentially the same as the internal diameter of valve chamber 28. Insert 30 simultaneously serves to fix the suction hose 31 by plugging in, said hose extending directly into the vicinity of the bottom of storage vessel 20 and defines the suction port of pump 4 for the normal position shown in FIGS. 1 to 3. Suction port 33 for the opposite inverted position is formed by at least one and in particular several openings uniformly distributed around the circumference in the jacket of cylinder 14, which pass through the piston path 15 in an area which is immediately adjacent to the bearing edge of piston lip 19 with pump piston 17 in the initial position. The suction port 33 or the associated openings pass through the outer circumference of cylinder 14 in an area which, in the case of the fitted delivery apparatus 1, is immediately adjacent to the neck 3 is storage vessel 2, i.e. in the inverted positions is in the approxiamtely lowest area of the interior of storage vessel 2 intended for receiving the medium, so that even in the inverted position vessel 2 can be substantially completely emptied by pump 4.

Piston unit 16 is provided with a piston collar 34 constructed in one piece with the sleeve-like, hollow pump piston 17 and connected to the rear end thereof. Piston collar 34 is also closed in sleeve-like manner and extends to the outside over the exterior of pump casing 6 or cylinder cover 12 into the outer part of actuating head 7. Piston collar 34 defines a discharge passage 35 located therein connecting pump chamber 20 through pump piston 17 to discharge port 8, while interposing a mechanically opening discharge valve 36. The annular valve seat of the discharge valve 36 located roughly in the center of the length of piston collar 34 or in the vicinity of the inner end of cylinder cover 12 is formed by a radially inwardly projecting annular bead 38 of piston collar 34. Valve body 39 of discharge valve 36 is located completely within the piston collar 34 substantially on the side of the valve seat 37 facing pump chamber 20, its frustum-shaped, outwardly tapering valve closing face 40 being formed by the end face of the collar-like valve body 39 remote from pump chamber 20. Valve body 39 is constructed in one piece with a valve stem 41 which, for leaving free the discharge passage 35, is slotted longitudinally or axially in the circumference in such a way that it is e.g. cross-like in cross-section and has through, cylindrical circumferential faces over its length. By means of these circumferential faces, the valve stem 41 in the outer piston neck 56 of piston collar 34 engaging in actuating head 7 is slidably guided parallel to the central axis 10, said cylindrical sliding face of piston collar 34 passing in the direction of valve seat 27 into an acute-angled, frustum shaped-widened inner face, so that at least in the open position of discharge valve 36, the valve stem 41 performs pendulating movements within narrow limits and as a result the valve body 39 can be accurately oriented on the valve seat 37.

A restoring spring e.g. in the form of a helical compressing spring within cylinder casing 11 is provided for closing discharge valve 36, said spring passing through the pump piston 17 and the piston collar 34 up to valve body 39 and is supported on the end face of valve body 39 remote from the closing face 40 and at right angles to the central axis 10. On this end face, valve body 39 has a projection for the centred engagement in restoring spring 42. The other end of restoring spring 42 located in pump chamber 20 is supplied on an axially secured intermediate member 43 located immediately adjacent to valve opening 29 in cylinder casing 11 and which also engages into the spring 42 with a centering projection, which projects into pump piston 17 in any position thereof.

In the initial position of the pump or in the closing position of discharge valve 36, the valve stem 41 projects up to the other end of piston neck 56, in such a way that the end face 44 of valve stem 41 is located in the plane of the outer end face of piston collar 34. On the outer circumference, piston neck 56 of piston collar 34 is surrounded with easy sliding fit by a sliding sleeve 45 of actuating head 7. Sliding sleeve 45 projects into the pump casing 6 in any position of piston unit 16 and has a much smaller external diameter than the outer actuating part of actuating head 7 used for engaging over cylinder cover 12 in cap-like manner. Piston collar 34 and sliding sleeve 45 can engage in one another via a ring flange and an annular clearance in such a way that they are displaceable with respect to one another in stop-limited manner between two axial end positions. In the represented embodiment on the o352 flange 46 engaging in an inner slot of sliding sleeve 45 is provided close to the outer end of piston collar 34. Actuating head 7 with the free end of an internal ram 47 provided in the central axis 10 engages on end face 44, said ram being located in an annular portion 48 of discharge passage 35, from which emanates the passage portion leading to discharge port 8 and which is e.g. at right angles to the central axis 10.

The intermediate body 43 forms an annular inner shoulder 49 facing the pump piston 19, which forms the end of the piston path 15 and is immediately adjacent thereto. At the end of the piston stroke, the front face of the pump piston 17 runs against said inner shoulder 49, the intermediate body 43 engaging with a ring extension projecting over inner shoulder 49 into the piston lip 19 of pump piston 17 in such a way that it engages on the inner face of lip 19 and prevents deformation thereof.

The described pump operates according to the following process. If the actuating head 7 is pressed down manually against the tension of restoring spring 42, then at the start of this movement, the piston lip 19 passes over the openings in suction port 33 located in piston path 15, so that closure thereof takes place in the manner of a slide control. Moreover, in the normal position, the valve arrangement 22 is closed at the part of this movement due to the fact that the valve body 27 sealingly engages on valve seat 25. During the further movement, a pressure builds up in pump chamber 20 until pump piston 17 has reached inner shoulder 49 and consequently secures the pump piston 17 against further movements in the direction of pump stroke 18. Before reaching this position (the discharge valve can optionally be opened at a point up to the beginning of the pump stroke by means causing the piston neck 56 of piston collar 34 to become displaced upwardly in range 50 of its sliding engagement with sliding sleeve 45)

actuating head 7 is moved with respect to the piston unit 16 or the valve seat 37 in the direction of the pump stroke indicated by arrow 18 by the amount of the valve opening stroke 50, so that the valve body 39 according to FIG. 3 passes into its open position counter to the tension of restoring spring 42 and the discharge valve 36 is opened. The medium under pressure in pump chamber 20 can therefore be discharged via discharge valve 36 and the outlet port 8 of actuating head 7. Through the manual release of actuating head 7, the return stroke is initiated, during which initially the restoring spring 42 transfers the valve body 39 into the closed position, whilst also entraining the actuating head 7. Only through the engagement of the valve closing face 40 on valve seat 37 is the remaining piston unit 16, i.e. also pump piston 17 carried along and brought into the initial position. Valve body 27 of valve arrangement 22 is raised from valve seat 25, the flow conditions being such that the valve body 27 cannot pass into its second closed position, namely in the position engaging on valve seat 26 and consequently medium is sucked into the pump chamber 20 through suction port 32. Then, the next pump stroke can be performed in the described manner.

In the inverted position of the delivery apparatus 1, under the weight force acting thereon, valve body 27 drops into the valve seat 26 and the medium in the storage vessel 2 collects in the head space of vessel 2 surrounding pump 4 in such a way that the suction passage 33 is immersed in the medium, whereas the suction opening of suction passage 32 belonging to the storage vessel is not immersed. If a pump stroke is now performed, after passing over and closing the suction passage 33 by pump piston 17, the medium in pump chamber 20 is initially displaced through the valve opening 29, the jet passing out of the latter into valve chamber 28 striking the valve body 27 in valve seat 26 and moves it sealingly against valve seat 25, so that the suction passage 32 is closed. As a result of the pressure building up in pump chamber 20, valve body 27 is held in this closed position. At the end of the pump stroke, the discharge valve 26 opens in the described manner. With the start of the return stroke of piston 17, the valve body 27 in the inverted position drops back into valve seat 26, so that the pump chamber 20 is sealingly closed with respect to vavle chamber 28 or suction passage 32 and during the return stroke a vacuum builds up in pump chamber 20. At the end of the return stroke the pump piston 17 frees the suction passage 33 to pump chamber 20, so that it is sucked full with medium and is ready for a further pump stroke.

For air compensation in the area of the pump casing 6 separated from pump chamber 20 by pump piston 17, as well as for storage vessel 2, an air compensating duct 51 connecting said space to the atmosphere is provided and said duct is defined in annular clearance-like manner by an inner sleeve 52 and the piston collar 34 or sliding sleeve 45 passing through the same. Inner sleeve 52 is provided on cylinder cover 12 and projects freely into cylinder casing 11. In the vicinity of pump piston 17 an air compensating valve 53 is provided for the air compensating duct 51 and when the pump is in the initial position it is hermetically closed and opens mechanically on operating the pump. This air compensating valve 53 is formed by an outwardly conically tapered closing face 54 of pump piston 17 connected to piston lip 19 and with which as valve seat 55 is associated the inner end of inner sleeve 52. Through the engagement of abutment means defined by closing face 54 on valve seat 55 the movement of the piston unit on the return stroke is stop-limited, so that the valve 53 is reliably closed in this position.

The air compensating duct 51 is also provided for the air or pressure compensation in storage vessel 2, for which purpose is provided an air compensating connection between the inner area of pump casing 6, i.e. between the part of the casing inner area connected to the air compensating duct 51 and separated from pump chamber 20 by pump piston 17 or piston lip 19 and the interior of the storage vessel 2. This air compensating connection is closed in the same way as the air compensating valve 53 by slide control in the inoperative or initial position of pump piston 17. It is in fact formed by the suction passage 33. As soon as the piston unit 16 has been advanced from the initial position by a predetermined amount in the pump stroke arrow direction 18, the air compensating connection to said part of the casing inner area is opened and consequently connected to or open towards the air compensating duct 51. During the return stroke, shortly before closing the air compensating valve 53, said air compensating connection is closed again. With respect to the inner area of storage vessel 2, two air compensating valves, namely air compensating valve 53 and the slide-controlled valve are provided in successively operating manner, being formed by the interaction between suction passage 33 and piston lip 19. This improves the reliability of sealing of the pump to the outside and it is conceivable that even without a light closure adequate security is provided in the vicinity of valve seat 55, so that the engagement of pump piston 17 of valve seat 55 can also be provided solely for the stop limitation of the initial position of piston unit 16. It is assumed that in the inverted position after the piston lip 19 has passed over the suction passage 33, the pump tends to permit the passage of leaking medium through air compensating duct 51, but in practice this is not the case. It is important that the air compensating connection between the casing interior and the storage vessel is provided solely by slide-controlled openings and otherwise there are no other air compensating connections for the storage vessel.

Thus, the suction passage 33 can be very close to the storage vessel 2 and, in the inverted position, forms its lowest area. In addition, the piston unit 16 need only have a single slide and piston lip 19 which, at the start of the closure of suction passage 33 with respect to pump chamber 20, opens the air compensating connection formed by said passage 33. The complete empty space of the pump casing 6 separated from the sealing edge of pump piston 17 with respect to pump chamber 20 is tightly closed with respect to the storage vessel 2 in the initial position of piston unit 16.

Figure 4:
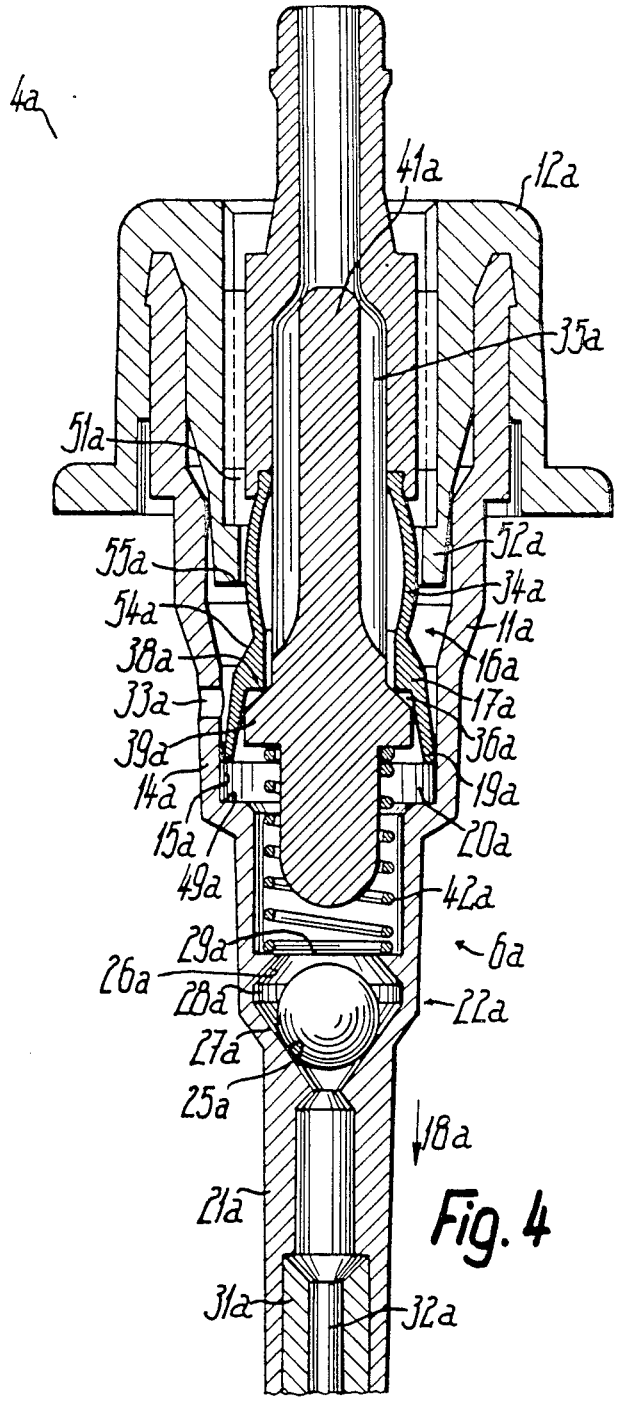
FIG. 4 A further embodiment of a pump in axial section and in a pump piston position between its two end positions.
Figure 5:
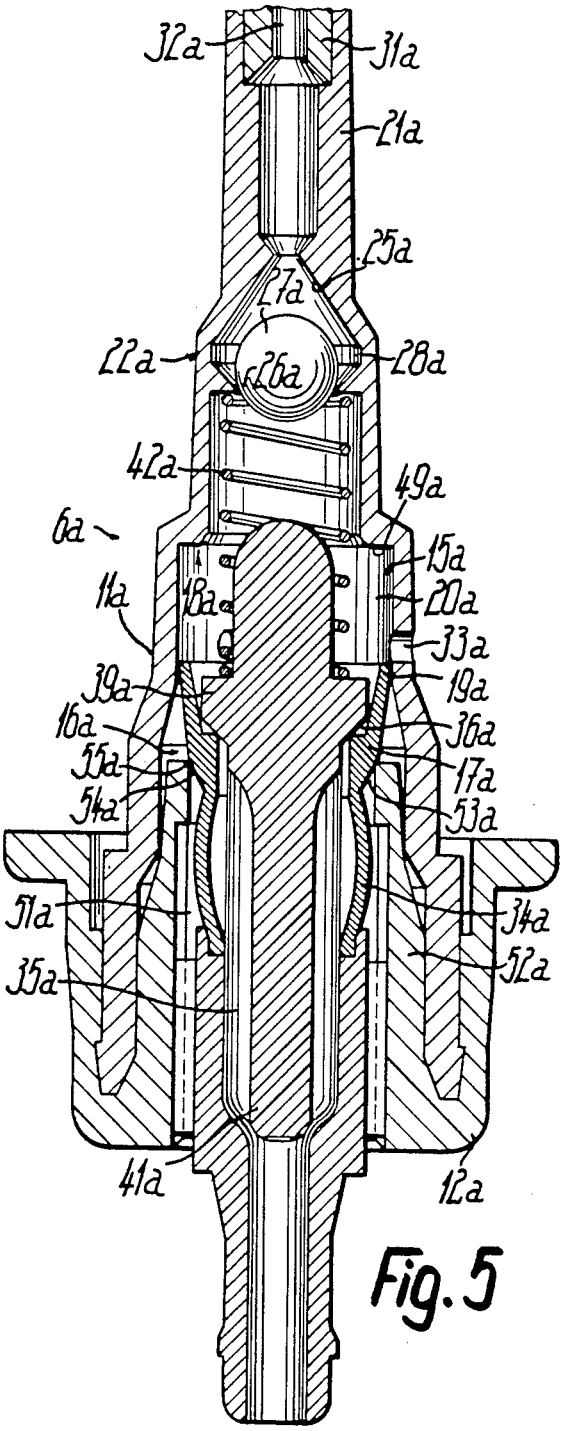
FIG. 5 Shows the pump according to FIG. 4 in the inverted position and with the pump piston in the initial position.

In FIGS. 4 and 5, the corresponding parts carry the same reference numerals as in FIGS. 1 to 3, except that the letter "a" has been added. The two valve seats 25*a*, 26*a* of the valve arrangement 22*a* for the suction passage 32*a* have different cone angles, being constructed in both cases inegrally with the cylinder casing 11*a*. It is therefore conceivable to construct valve seat 26*a* and valve opening 29*a* in such a way that the valve body 27*a* is held with a predetermined blocking or fixing in valve seat 26*a* in the inverted position according to FIG. 5. This securing action is overcome on reaching a corresponding over pressure in pump chamber 20*a* during the pump stroke, so that the valve body 27*a* is transferred suddenly into its closed position engaging on valve seat 25*a*.

The pump piston 17*a* is constructed with an elastically compressible piston neck 34*a*, which forms the closing spring for discharge valve 36*a*. The end of the piston neck 34*a* remote from piston lip 19*a* is fixed in sealed manner in valve stem 41*a*. Valve stem 41*a* simultaneously forms the piston rod or the pump plunger receiving the actuating head, which is not shown in detail.

What is claimed is:

1. A delivey apparatus for discharging liquid media and the like from a storage chamber in an inverted position, said apparatus comprising:

a thrust piston having a cylinder and a piston unit for defining a pump chamber therein, said cylinder and said piston unit being displaceable with respect to each other over a pump stroke;

a discharge passage being provided for discharging the media from the piston pump and the cylinder having suction passage means for filling the piston pump with media in the inverted position;

an air pressure compensating duct in the cylinder of said piston pump for controlling the pressure in the storage chamber; and, a slide control element for closing said air compensating duct over at least a part of the pump stroke, wherein said piston unit has a piston lip slidably engaging the cylinder, said piston lip forming the slide control element both for closing the air compensating duct and for closing the suction passage for the inverted position.

2. An apparatus according to claim 1, wherein the piston unit has only one single piston lip, said single piston lip forming the slide control element both for closing the air compensating duct and for closing the suction passage for the inverted position.

3. The delivery apparatus according to claim 1, further comprising a discharge valve for said discharge passage, said discharge valve having a valve closing seat and a discharge valve body for engagement with said valve closing seat upon closing of the discharge valve, the discharge valve body being mounted for movement between closed and opened positions for opening the discharge passage, the discharge valve body being mechanically connected to an actuating head for movement via a sliding fit arrangement from the closed position into the open position by operation of the actuating head, means being provided for positively moving the discharge valve body into the open position.

4. An apparatus according to claim 3, wherein said sliding fit arrangement comprises the valve body and the actuating head engaging each other by a sliding fit, said discharge valve being controlled in a path-dependent manner as a function of said pump stroke, said discharge valve being opened after development of a high pressure in the pump chamber by displacement of the pump piston along the pump stroke.

5. An apparatus according to claim 3, wherein said sliding fit arrangement comprises sliding fit engagements between said actuating head and said discharge valve body and between said actuating head and said piston unit.

6. An apparatus according to claim 3, wherein said discharge valve body and said actuating head are connected to each other in a fixed relative position with respect to any displacement in the pump stroke and a return stroke.

7. An apparatus according to claim 3, wherein means are provided for urging the discharge valve towards the closed position at a beginning of a return stroke of the piston unit.

8. An apparatus according to claim 3, further comprising an abutment means associated with said cylinder for positively holding said valve seat in an initial position at an end of the return stroke, the abutment means being fixed relative to the cylinder, said abutment means being provided for transferring said discharge valve body to said closed position.

9. An apparatus according to claim 3, wherein only a single spring is provided for acting on the discharge valve body as a pump return spring and as a valve closing spring.

10. An apparatus according to claim 3, wherein the valve closing seat, of the discharge valve is formed by a sleeve-like piston collar traversed by the discharge passage and forming a pump piston of the piston unit, the discharge valve body being displaceably mounted in the piston collar, said piston collar being elongated to define a piston neck for slidably receiving a valve stem of the discharge valve, said piston neck forming an end of the piston collar remote from the pump piston, the actuating head being mounted directly in the piston neck.

11. An apparatus according to claim 10, wherein said piston neck forms a stop-limiter for stop-limiting the valve stem in the closed position of the discharge valve when moved in a moving direction of the pump stroke of the piston unit.

12. An apparatus according to claim 10, wherein said means for positively moving the discharge valve body comprises a stop-limit for the piston pump at the end of the pump stroke, the discharge valve body being mounted for displacement in the cylinder by the actuating head and on the piston neck, for common movement up to an end position at the end of the pump stroke, whereupon the means for stop-limiting the piston pump opens the discharge valve.

13. An apparatus according to claim 12, wherein the means for positively moving the discharge valve body includes an inner shoulder for stop-limiting the pump piston at an end position at the end of the pump stroke, the inner shoulder being located at the end of a piston path provided by the cylinder, a projection defined by the inner shoulder extending into a path of the pump piston.

14. An apparatus according to claim 10, wherein said actuating head has a sliding sleeve for receiving said piston neck.

15. An apparatus according to claim 14, wherein said sliding fit arrangement comprises a sliding fit engagement between said piston neck and the valve stem and between said piston neck and said sliding sleeve.

16. An apparatus according to claim 15, wherein said means for positively moving the discharge valve body includes said piston lip engaging an extension of the pump cylinder at the end of the pump stroke, said extension engaging said piston lip in a non-deforming securing manner, said piston lip being an acute-angled, frustrum-shaped sleeve.

17. A delivery apparatus for discharging liquid media and the like from a storage chamber in a normal upright position and in an opposite inverted position, said apparatus comprising:

a thrust piston pump having a cylinder and a manually displaceable piston unit for defining a pump chamber therein, said cylinder and said piston unit being displaceable with respect to each other over a pump stroke;

a discharge passage being provided for discharging the media from the piston pump and the cylinder having respective suction passages for filling the piston pump with media in the normal upright position and in the inverted position;

a valve arrangement for closing the suction port for the normal upright position, the valve arrangement having means for at least partly defining two check valves, one of said check valves closing the suction passage in event of an overpressure condition in the pump chamber and the other of said check valves closing in the inverted position in event of a vacuum condition in the pump chamber; and, an air pressure compensating duct in the cylinder of said piston pump for controlling a pressure in the storage chamber, wherein the suction passage for the inverted position comprises the air pressure compensating duct for the storage chamber in both the upright and inverted positions.

* * * * *

UNITED STATES PATENT AND TRADEMARK OFFICE

CERTIFICATE OF CORRECTION

PATENT NO. : 4,958,752

DATED : September 25, 1990

INVENTOR(S) : MAERTE

It is certified that error appears in the above-identified patent and that said Letters Patent is hereby corrected as shown below:

Title page, item (54):

Please delete the title "INVENTION BUMP FOR LIQUID MEDIA" and replace with --INVERTABLE PUMP FOR LIQUID MEDIA--.

Title Page 1, column 1, replace "885,505" with --855,505--.

Column 1, line 9, replace "cylinders" with --cylinder--.
line 47, replace "resistance" with --resistances--.
line 51, replace "dischraged" with --discharged--.

Column 2, line 8, replace "cross-section" with --cross-sections--.
line 29, replace "conected" with --connected--.
line 62, replace "comrpession" with --compression--.

Column 3, line 10, replace "favourable" with --favorable--.
line 42, replace "position" with --positions--.

Column 4, line 1, replace "Show" with --Shows--.
line 7, replace "A" with --Shows a--.

Column 4, line 33, after "cylinder", (second occ.) insert --cover--.

UNITED STATES PATENT AND TRADEMARK OFFICE

CERTIFICATE OF CORRECTION

PATENT NO. : 4,958,752

DATED : September 25, 1990

INVENTOR(S) : MAERTE

It is certified that error appears in the above-identified patent and that said Letters Patent is hereby corrected as shown below:

Column 5:

line 8, replace "valve seat 26" with --The other valve seat 26--.

line 27, replace "is" with --in--.

line 28, replace "approxiamtely" with --approximately--.

line 55, replace "in" with --on--.

Column 6, lines 1-2, replace "compressing" with --compression--.

line 8, replace "centred" with --centered--.

line 10, replace "supplied" with --supported--.

line 18, replace "other" with --outer--.

line 57, replace "part" with --start--.

Column 7, line 13, replace "whilst" with --while--.

line 42, replace "26" with --36--.

line 46, replace "vavle" with --valve--.

Column 8, line 31, replace "light" with --tight--.

line 61, replace "inegrally" with --integrally--.

UNITED STATES PATENT AND TRADEMARK OFFICE

CERTIFICATE OF CORRECTION

PATENT NO. : 4,958,752

DATED : September 25, 1990

INVENTOR(S) : Leo Maerte, et al.

It is certified that error appears in the above-identified patent and that said Letters Patent is hereby corrected as shown below:

Column 5, line 3, after "of" insert --a--.

Column 6, line 32, replace "0352" with --outer circumference of piston neck 56, the ring--.

Claim 10, column 10, line 27, replace "in" with --on--.

Signed and Sealed this

Ninth Day of February, 1993

*Attest:*

STEPHEN G. KUNIN

*Attesting Officer*

*Acting Commissioner of Patents and Trademarks*